US006957644B2

(12) United States Patent
Simo et al.

(10) Patent No.: US 6,957,644 B2
(45) Date of Patent: Oct. 25, 2005

(54) MECHANICAL RELEASE OR TRIGGER DEVICE

(76) Inventors: Miroslav A. Simo, 370 N. Delaplaine, Riverside, IL (US) 60546; Frank A. Harwath, 2420 Cloverdale Rd., Naperville, IL (US) 60564

( * ) Notice: Subject to any disclaimer, the term of this patent is extended or adjusted under 35 U.S.C. 154(b) by 0 days.

(21) Appl. No.: 10/723,611

(22) Filed: Nov. 26, 2003

(65) Prior Publication Data

US 2005/0121013 A1 Jun. 9, 2005

(51) Int. Cl.[7] ..... F41B 5/18
(52) U.S. Cl. ..... 124/35.2; 124/31; 42/69.01
(58) Field of Search ..... 124/25, 31, 35.2; 42/65, 69.01

(56) References Cited

U.S. PATENT DOCUMENTS

| | | | | |
|---|---|---|---|---|
| 1,285,885 | A * | 11/1918 | Younger | 42/69.01 |
| 2,841,908 | A | 7/1958 | Bourquin | |
| 3,188,764 | A * | 6/1965 | Harding | 42/69.01 |
| 3,879,877 | A | 4/1975 | Cizeron | |
| 4,041,925 | A | 8/1977 | Barrick | |
| 4,151,825 | A | 5/1979 | Cook | |
| 4,466,418 | A | 8/1984 | Jones | |
| 4,625,443 | A * | 12/1986 | Beretta | 42/42.03 |
| 4,672,945 | A | 6/1987 | Carlton | |
| 4,742,812 | A * | 5/1988 | Goodman | 124/25 |
| 5,020,508 | A | 6/1991 | Greene, Jr. | |
| 5,031,600 | A | 7/1991 | Moore | |
| 5,067,472 | A | 11/1991 | Vogel et al. | |
| 5,103,796 | A | 4/1992 | Peck | |
| 5,184,596 | A | 2/1993 | Green et al. | |
| 6,189,525 | B1 | 2/2001 | Kutrubes | |
| 6,205,991 | B1 * | 3/2001 | Summers et al. | 124/35.2 |
| 6,223,644 | B1 | 5/2001 | Troncoso | |
| 6,336,283 | B1 | 1/2002 | Ortiz | |
| 6,367,465 | B1 | 4/2002 | Buccieri, Jr. | |
| 6,651,642 | B1 * | 11/2003 | Powers | 124/35.2 |

* cited by examiner

*Primary Examiner*—John A. Ricci
(74) *Attorney, Agent, or Firm*—Pauley Petersen & Erickson

(57) ABSTRACT

A mechanical release or trigger device including a body. A trigger forming a shaft is movably mounted with respect to the body. At least one caliper is mounted with respect to the body and operatively connected to the trigger. The caliper is movable between a closed position and an open position, in response to a movement of the trigger. A sleeve is rotatably mounted with respect to the trigger and movable along an axis of the shaft. At least one stop element can be mounted with respect to the shaft at a first end portion of the sleeve or a second end portion of the sleeve, to limit axial movement of the sleeve. In one embodiment wherein the sleeve is asymmetric, and operatively connected to activate another mechanism such as a safety or firing system, a bias element can be operatively connected to the sleeve to bias the sleeve towards a first rotational position.

30 Claims, 13 Drawing Sheets

MECHANICAL RELEASE OR TRIGGER DEVICE

BACKGROUND OF THE INVENTION

1. Field of the Invention

This invention relates to a mechanical release or trigger device that can be used to activate a release mechanism, for example in combination with an archery bow to release a bowstring and thus launch an arrow, or in combination with a firearm to fire a projectile.

2. Description of Related Art

Conventional trigger devices are used in combination with an archery bow wherein a release aid secures an archery bowstring as the archery bowstring is drawn back, and then a trigger activates the release aid to open calipers or another mechanical element, to release a bowstring from a drawn position and thus launch an arrow. In many conventional trigger devices, the trigger is pivotally mounted to a trigger body and mechanically connected with the release aid, to open the calipers in response to a pulling and pivotal movement of the trigger. Such pulling movement of the trigger typically results in an undesirable movement of or force on the bowstring in a vertical, horizontal and/or forward/rearward vector or direction.

Ideally, in order to maintain shot accuracy, the trigger should be pulled in a direction parallel to the arrow positioned with respect to the bowstring. A trigger pull that is not in line or parallel with the arrow negatively influences shot accuracy. A user's finger is pivotally or hingedly connected to the user's hand at the knuckle or joint. During a pulling movement of the finger on the trigger, the trigger is pulled to release the archery bowstring. However, a finger cannot pull the trigger straight back because of its pivotal or hinged connection to the user's hand. Thus, there will always be a curvature to the trigger pull. For example, a point on the finger travels along an arc with respect to the pivotal connection with the hand and not a straight line during this pulling movement. This pulling movement can result in undesired movement of or force on the trigger device in a vertical, horizontal and/or forward/rearward vector or direction, which negatively influences shot accuracy. With conventional trigger devices, as a user's finger is applied to pull or force a trigger in a pivot direction, because of friction between the user's finger and the trigger, a trigger body moves with respect to a bowstring and causes an undesired misalignment of the trigger body with respect to the bowstring. It is highly desirable to maintain the position of the trigger body with respect to the bowstring when pulling the trigger in the pivot direction, so that the trigger device does not apply an undesired force on the bowstring.

For example, as shown in FIG. 1, as a force is applied to a conventional pivoting trigger, frictional forces between the finger and the trigger result in a resultant force $F_R$ having a first force component $F_1$ in a X direction, a second force component $F_2$ in a Y direction and a third force component $F_3$ in a Z direction. The second force component $F_2$ representing movement of the trigger device in the Y direction with respect to the bowstring and/or an arrowshaft will misalign the trigger device with respect to the bowstring. Similarly, the third force component $F_3$ representing movement of the trigger device in the Z direction with respect to the bowstring and/or the arrowshaft will misalign the trigger device with respect to the bowstring. Force components $F_2$ and $F_3$ acting on the bowstring will apply an undesired force on the bowstring, misalign the arrowshaft with respect to a target, and result in an inaccurate arrow launch. Not all conventional triggers pivot but may move differently due to the mechanical linkages of the trigger and/or the release aid. However, similar problems result because a user's fingers will not move precisely or synchronously with the movement of the mechanical linkages. Therefore, undesirable resultant movement or force may be present in these conventional moving triggers as well.

Similar problems are associated with conventional firearm triggers that move or pivot to activate a release aid to fire a projectile for example. The frictional forces between the finger and the trigger produce an undesirable resultant movement or force that results in misalignment of the firearm barrel with respect to a target.

Thus, there is an apparent need for a mechanical release or trigger device that maintains a position of a trigger body with respect to a bowstring when pulling the trigger in the pivot direction, to release the bowstring.

There is also an apparent need for a mechanical release or trigger device that prevents or compensates for undesired force components as the trigger moves or pivots in a direction to prevent or limit vertical and/or lateral movement of the trigger body with respect to the bowstring.

There is also an apparent need for a mechanical release or trigger device that maintains a position of a firearm barrel with respect to a target when pulling a firearm trigger to activate a release aid to fire a projectile to prevent undesirable movement of the firearm with respect to the target.

SUMMARY OF THE INVENTION

One object of this invention is to provide a mechanical release or trigger device having a rolling sleeve or other similar mechanical element that is rotatably mounted with respect to a shaft of the trigger. As the trigger shaft moves or pivots with respect to the trigger body, a user's finger contacts the rolling sleeve which freely rotates about the trigger shaft and/or moves along the trigger shaft in at least one direction with respect to an axis of the trigger shaft. The rotational movement of the rolling sleeve about the trigger shaft and/or the axial movement of the rolling sleeve along the trigger shaft reduces a pulling force that, as discussed with respect to the prior art, would otherwise misalign the trigger body with respect to the bowstring when pulling the trigger in the firing or pivot direction.

The above and other objects of this invention are accomplished, according to one preferred embodiment of this invention, with a mechanical release or trigger device that includes a body. A trigger is movably mounted or connected with respect to the body. In one preferred embodiment of this invention, the trigger has or forms a shaft that is pivotally mounted or connected to the body. The trigger moves or pivots with respect to the body between a first position and a second position. The trigger may have a generally cylindrical shape or may have a curved or arcuate shape. The trigger shaft defines an axis that extends along a length of the trigger shaft.

The mechanical release or trigger device also includes a sleeve rotatably connected to the trigger. Preferably, the sleeve is positioned about at least a portion of the shaft. In one embodiment, the sleeve is movable along at least a portion of a length of the shaft and rotatable about the shaft with respect to the shaft axis. The sleeve may be one continuous piece or may be segmented, including a plurality of sleeve pieces each rotatable about and movable along the shaft with respect to the shaft axis. The sleeve may have a cylindrical outer surface or an asymmetric, an arcuate or a curved outer surface. For example, at least a portion of the sleeve may form a flange or lip surface. At least a portion of the sleeve outer surface may be knurled or otherwise roughened to provide frictional interference to prevent slippage of a user's finger as the user applies a force to the trigger to move or pivot the trigger between a first position and a second position. At least a portion of the sleeve outer surface can be made of a soft, conformable and/or resilient material to provide user comfort, reduce shock and increase firing accuracy.

In one preferred embodiment of this invention, for example wherein the sleeve is asymmetric, a bias element, such as a spring, is operatively connected between the shaft and the sleeve and creates an axial starting position that limits a rotational movement of the sleeve about the shaft axis. The asymmetric sleeve activates a mechanical element or suitable mechanism operatively connected to the trigger. For example, a pistol might have a safety or firing system that is activated by rotating the sleeve from a neutral, idle or starting position to a firing position. The bias element may be connected to the sleeve to bias or urge the sleeve towards the neutral, idle or starting position. With the trigger released, the bias element can urge the sleeve to the neutral, idle or starting position.

The mechanical release or trigger device may also include a stop element, for example a spring or resilient washer, positioned at or adjacent a first end portion of the sleeve to limit an axial movement of the sleeve along the shaft in a first direction with respect to the shaft axis. Similarly, a second stop element can be positioned at or adjacent a second end portion of the sleeve to limit axial movement of the sleeve along the shaft in a second direction with respect to the axis, generally opposite the first direction. An end cap can be connected or mounted to the trigger and/or the shaft to maintain a position of the sleeve about the shaft and to limit movement of the sleeve in one direction. Preferably, but not necessarily, the end cap is positioned at an outer end portion of the shaft. In one embodiment of this invention, the mechanical release or trigger device includes a stop pin that is connected with respect to the trigger having an asymmetric sleeve, to limit rotation of the sleeve about the shaft axis. A safety device, for example a safety lock, may be operatively connected to the trigger to prevent the trigger from moving or pivoting in the pivot direction.

In one preferred embodiment of this invention, the mechanical release or trigger device further includes at least one caliper or other suitable mechanical element movably mounted with respect to the body and operatively connected to the trigger. The calipers move between a closed position and an open position in mechanical response to a movement of the trigger which activates a release mechanism. In the open position, a bowstring positioned within or between the calipers is released to launch an arrow.

The mechanical release or trigger device of this invention can be used in combination with an archery bow or with a firearm, such as a gun or any other device that requires a pulling action or squeezing action of a trigger, to activate movement of another mechanical element. In one preferred embodiment of this invention, the mechanical release or trigger device includes a trigger that is movably mounted with respect to a gun body and movable between a first position and a second position. In one embodiment of this invention, the trigger is pivotally mounted to the gun body and pivotable between the first position and the second position. A sleeve is positioned with respect to the trigger shaft. Preferably, the sleeve is rotatably connected or positioned about the shaft. As a user's finger applies a force to the trigger, to move or pivot the trigger from the first position to the second position, the sleeve rotates about the trigger shaft to prevent or compensate for undesired lateral movement of the gun with respect to a target. Further, the sleeve may move along the shaft in a desired direction with respect to the shaft axis to prevent or compensate for undesired vertical movement of the gun with respect to the target.

In one preferred embodiment of this invention, the mechanical release or trigger device is used in combination with a firearm having a two-stage trigger. A two-stage trigger typically has three trigger positions, with a starting position, an intermediate position and an activating position. Movement from the first or starting position to the intermediate position generally requires a greater amount of force than movement from the intermediate position to the third or activating position. The two-stage trigger is considered to aid in target shooting accuracy. It should be apparent to those having ordinary skill in the art that the mechanical release or trigger device of the present invention is functionable with a trigger having any number of trigger positions.

BRIEF DESCRIPTION OF THE DRAWINGS

The drawings illustrate different features of a mechanical release or trigger device according to embodiments of this invention, wherein.

DETAILED DESCRIPTION OF PREFERRED EMBODIMENTS

This invention is directed to a mechanical release or trigger device for activating a trigger mechanism. Although the various aspects and embodiments of this invention are described in the context of a mechanical release or trigger device for use in combination with an archery bow for drawing an archery bowstring and moving or pivoting a trigger to activate a release mechanism to launch an arrow, the mechanical release or trigger device of this invention can be used in combination with a firearm, such as a gun, to launch or project any suitable projectile from a launching device, by moving or pivoting a trigger to activate a release mechanism.

Figure 1:
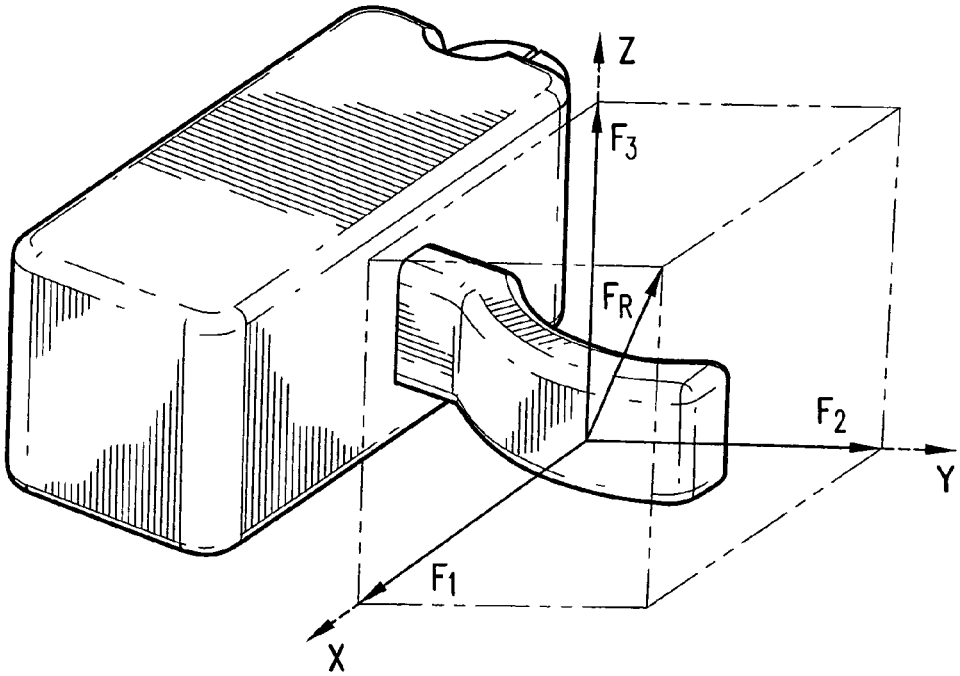
FIG. 1 PRIOR ART
FIG. 1 is conventional or prior art trigger device for use with an archery bow.
Figure 2:
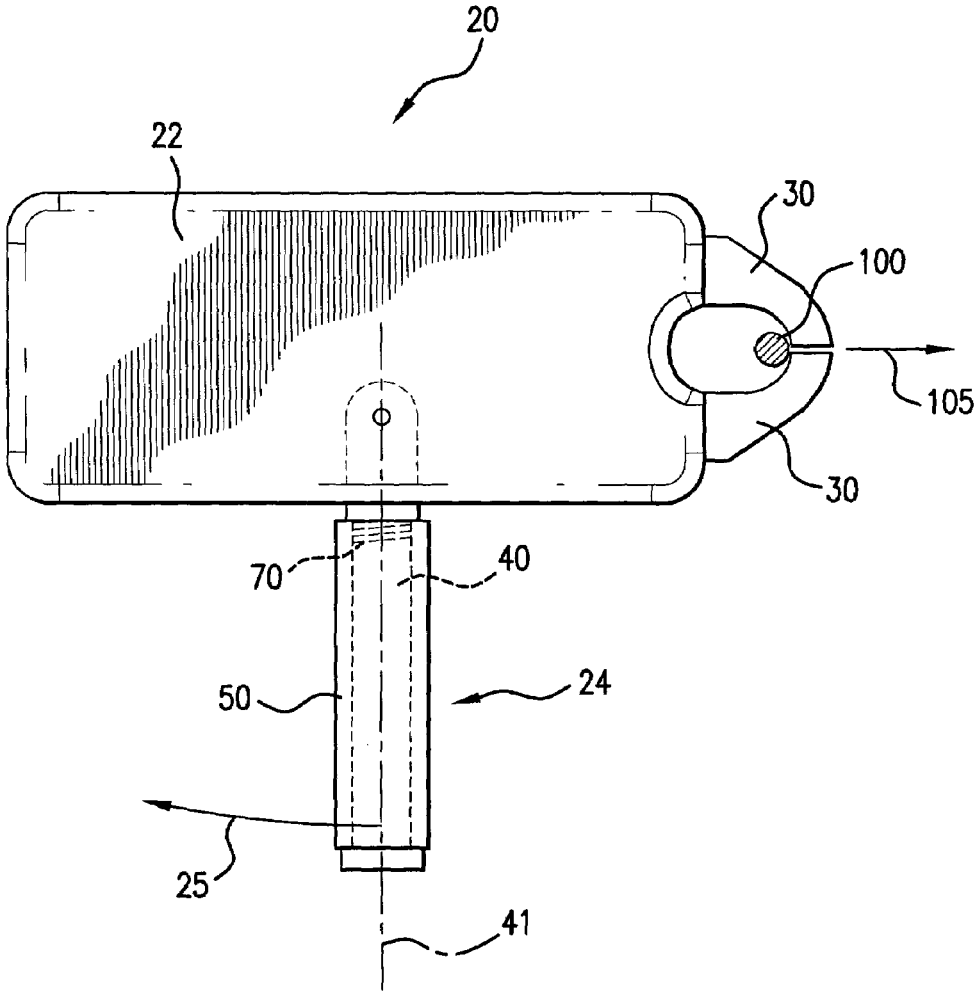
FIGS. 2–5 each shows a schematic view of a mechanical release or trigger device having a trigger with a cylindrical shaft and a sleeve mounted about the shaft, according to one embodiment of this invention.
Figure 3:
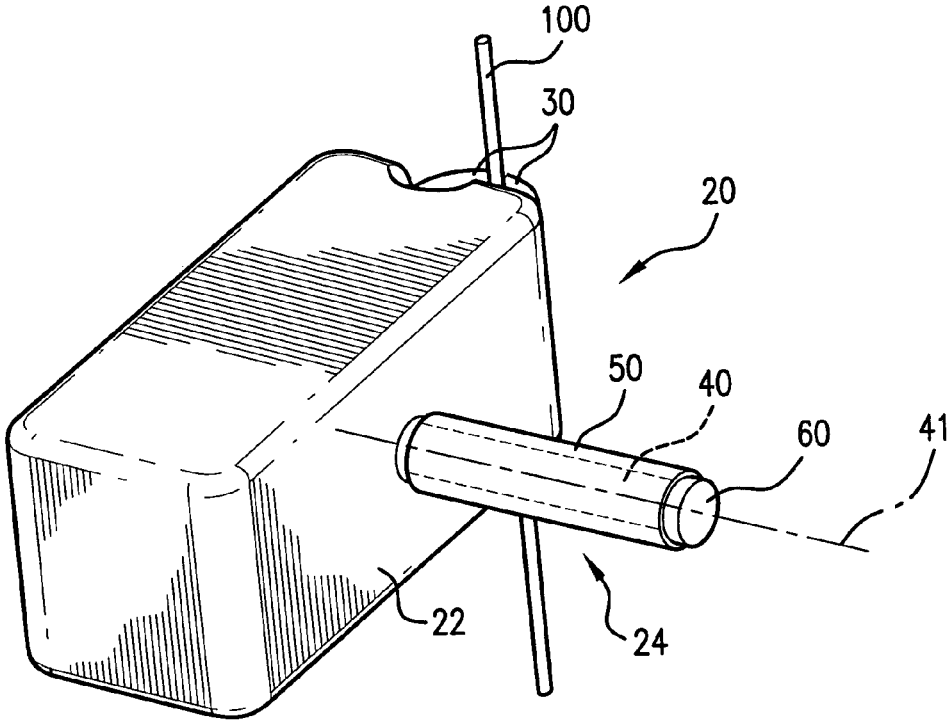

In one preferred embodiment of this invention as shown in FIGS. 2–11, a mechanical release device or trigger device 20 comprises a body 22. A trigger 24 is movably or pivotally mounted with respect to body 22. Trigger 24 can be pivotally mounted to body 22 and pivotable between a first position and a second position. For example, a user's finger is applied to force or urge trigger 24 in a pivot direction 25 from the first position to the second position, as shown in FIG. 2. At least one caliper 30 is operatively or mechanically connected to trigger 24 and movable between a closed position and an open position in response to a pivotal movement of trigger 24. The internal mechanical components mounted within body 22, which mechanically connect trigger 24 to activate calipers 30, are known to those skilled in the art of mechanical release devices or trigger devices.

Referring to FIG. 2 for example, trigger 24 is pivotable from the first position to the second position to move the calipers 30 from the closed position, as shown in FIG. 2, to the open position to release a bowstring 100 in a direction 105. Upon release of bowstring 100, trigger 24 moves, or is moved, from the second position back to the first position.

Figure 8:
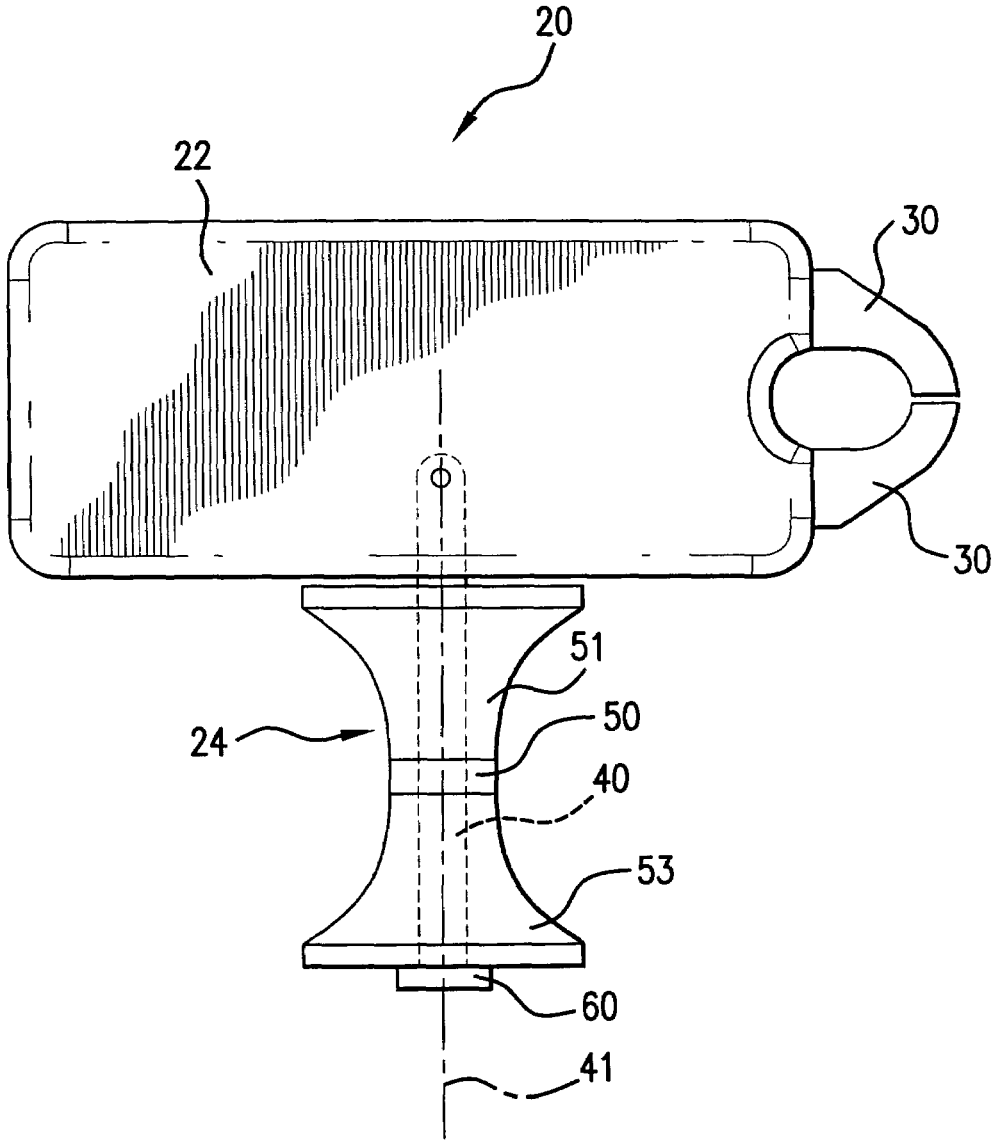
FIG. 8 shows a schematic side view of a mechanical release or trigger device having a sleeve forming an inner flange and an outer flange, according to one embodiment of this invention.
Figure 9:
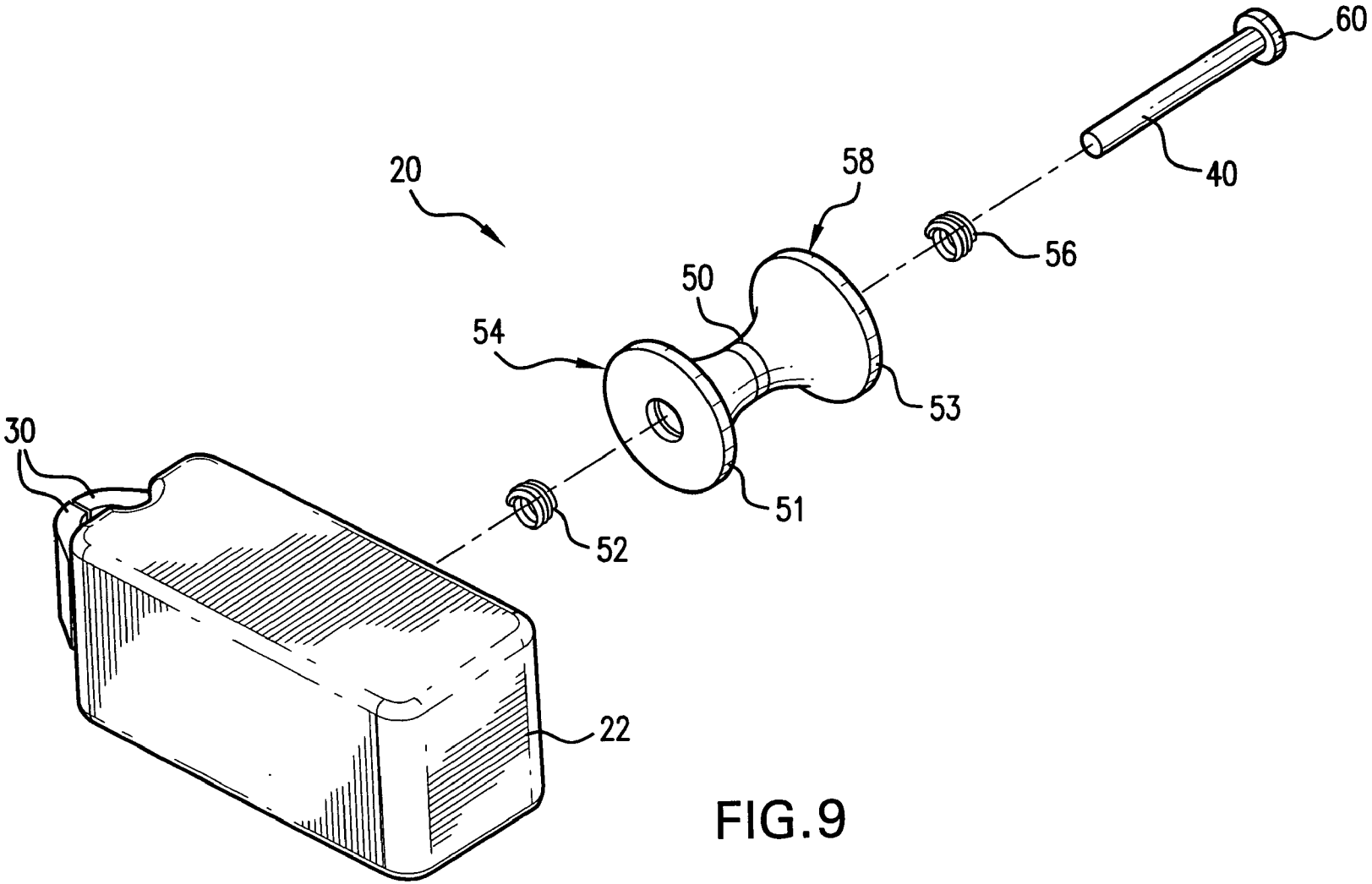
FIG. 9 shows an exploded perspective view of a mechanical release or trigger device, according to one embodiment of this invention.
Figure 10:
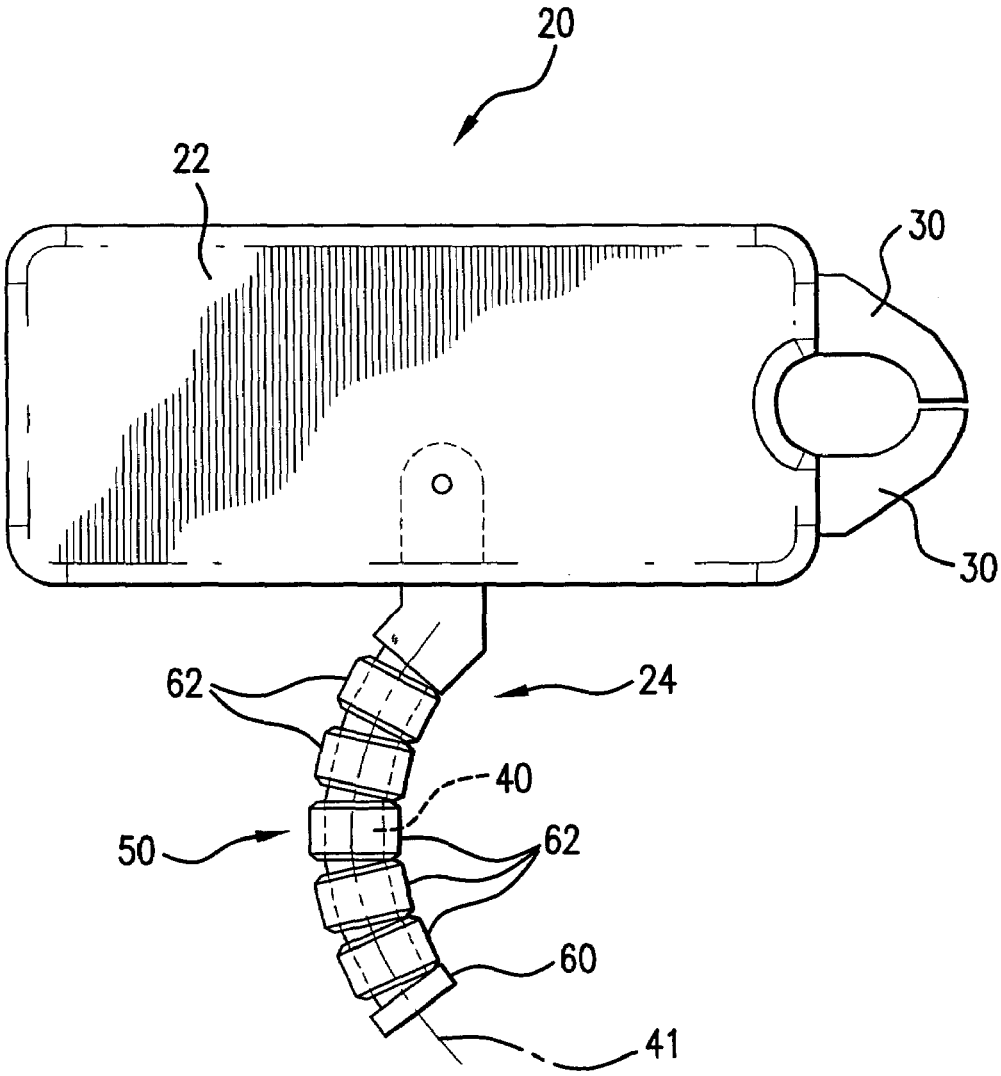
FIG. 10 shows a schematic side view of a mechanical release or trigger device having a segmented sleeve, according to one embodiment of this invention.

Referring to FIGS. 2–11, trigger 24 comprises a shaft 40 having or positioned with respect to an axis 41. As shown for example in FIGS. 2–9, shaft 40 may generally have a straight, cylindrical shape. However, as shown in FIG. 10, at least a portion of shaft 40 may have an arcuate or curved shape. Preferably, axis 41 extends along an overall or general length of shaft 40, whether shaft 40 is cylindrically shaped or curved or arcuate shaped.

A sleeve 50 is rotatably mounted with respect to trigger 24. Sleeve 50 may have any suitable shape and/or configuration. Preferably, sleeve 50 has a cylindrical or tubular shape and is positioned about at least a portion of a circumference or an outer surface of shaft 40. In one embodiment of this invention, sleeve 50 may comprise a rotatable member having a general "C" shape, which is positioned about shaft 40.

Figure 5:
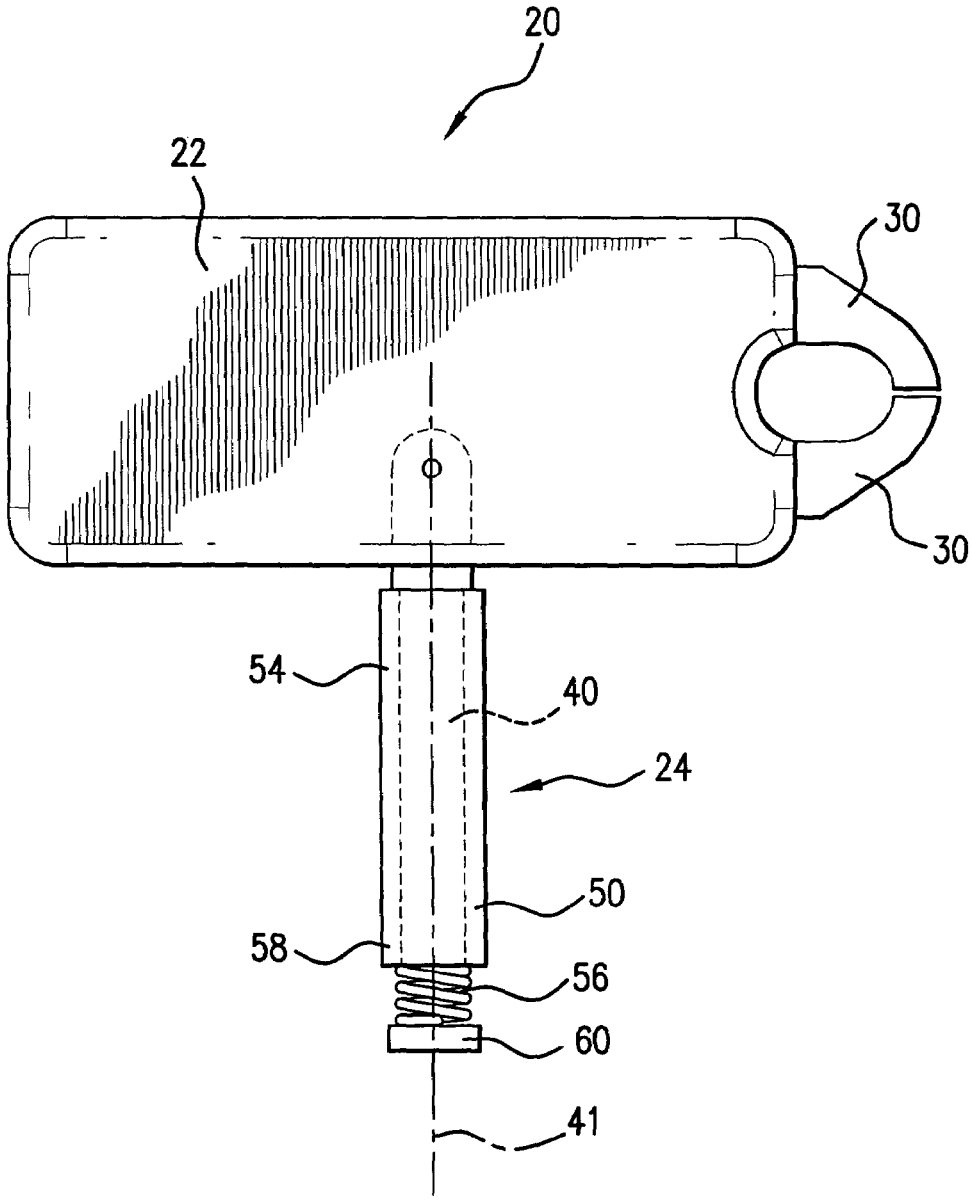
Figure 6:
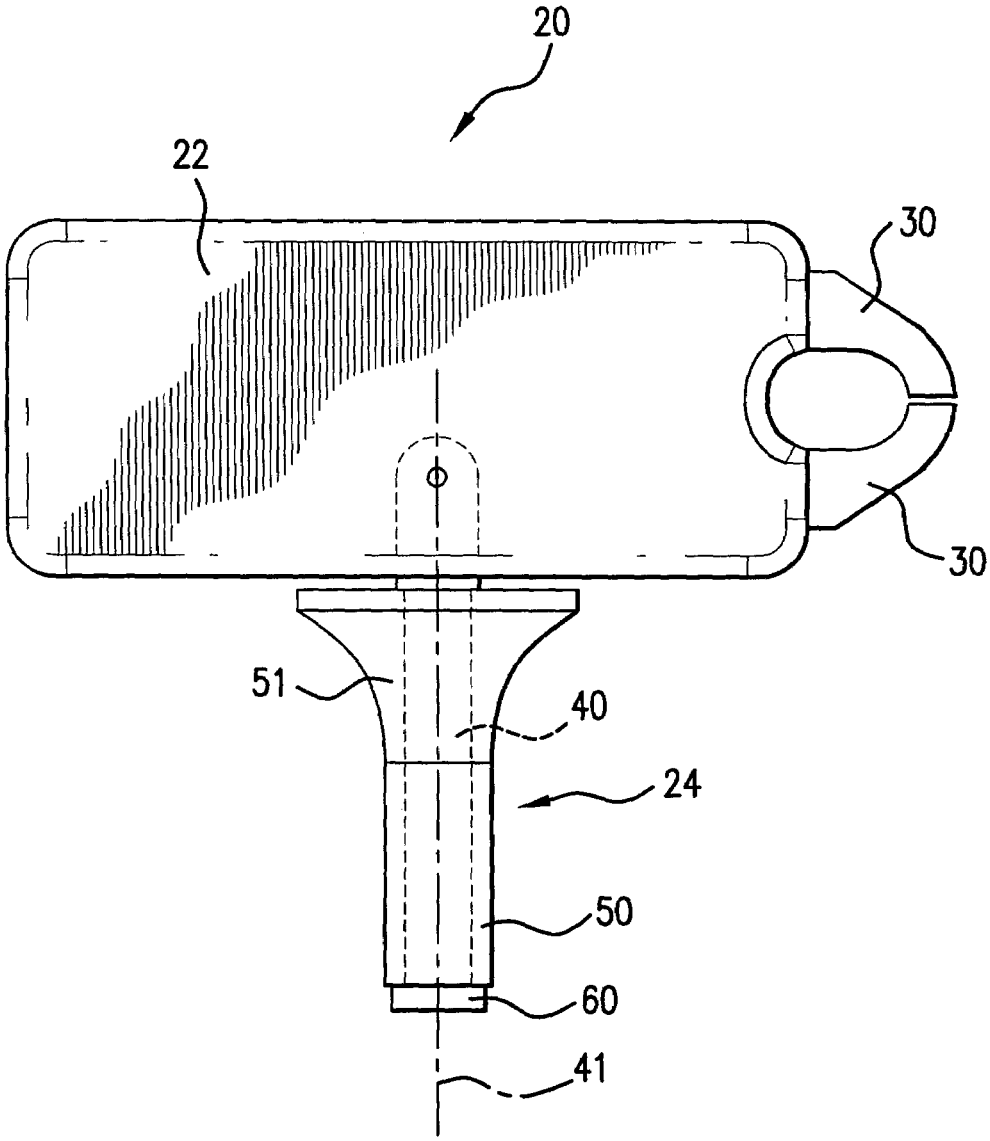
FIG. 6 shows a schematic side view of a mechanical release or trigger device having a sleeve forming an inner flange, according to one embodiment of this invention.
Figure 7:
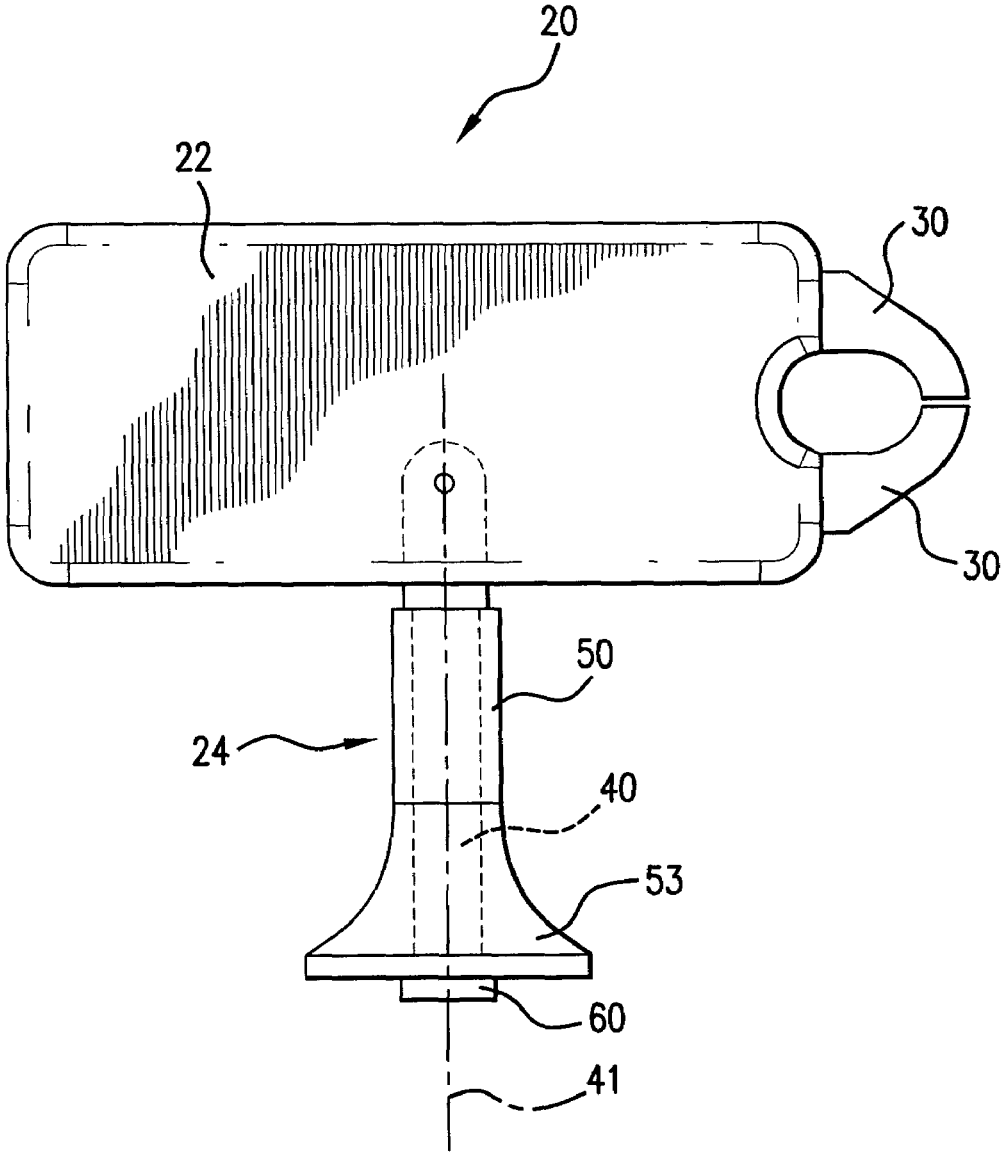
FIG. 7 shows a schematic side view of a mechanical release or trigger device having a sleeve forming an outer flange, according to another embodiment of this invention.

Preferably, sleeve 50 is rotatable about shaft 40 with respect to axis 41 and is movable along at least a portion of shaft 40 with respect to axis 41. Sleeve 50 may have a cylindrical outer surface, shown for example in FIGS. 2–5, or a curved or arcuate outer surface. For example, at least a portion of sleeve 50 may have a curved or arcuate shape to form an inner flange or lip surface 51, such as shown in FIG. 6, an outer flange or lip surface 53, such as shown in FIG. 7, or both inner flange 51 and outer flange 53, such as shown in FIG. 8. Further, in one preferred embodiment of this invention, at least a portion of the sleeve outer surface may be knurled or roughened to provide frictional interference to prevent a user's finger from slipping with respect to trigger 24 as the user applies a force to trigger 24 to pivot or move trigger 24 between the first position and second position. Alternatively, at least a portion of the sleeve outer surface may be smooth.

In one embodiment of this invention, at least a portion of the sleeve outer surface comprises a resilient material. For example, an elastomeric material may be applied to at least a portion of sleeve 50 to provide user comfort, absorb shock and/or increase firing or shooting accuracy. Other suitable soft, conformable and/or resilient materials may be applied to or positioned on sleeve 50.

Figure 4:
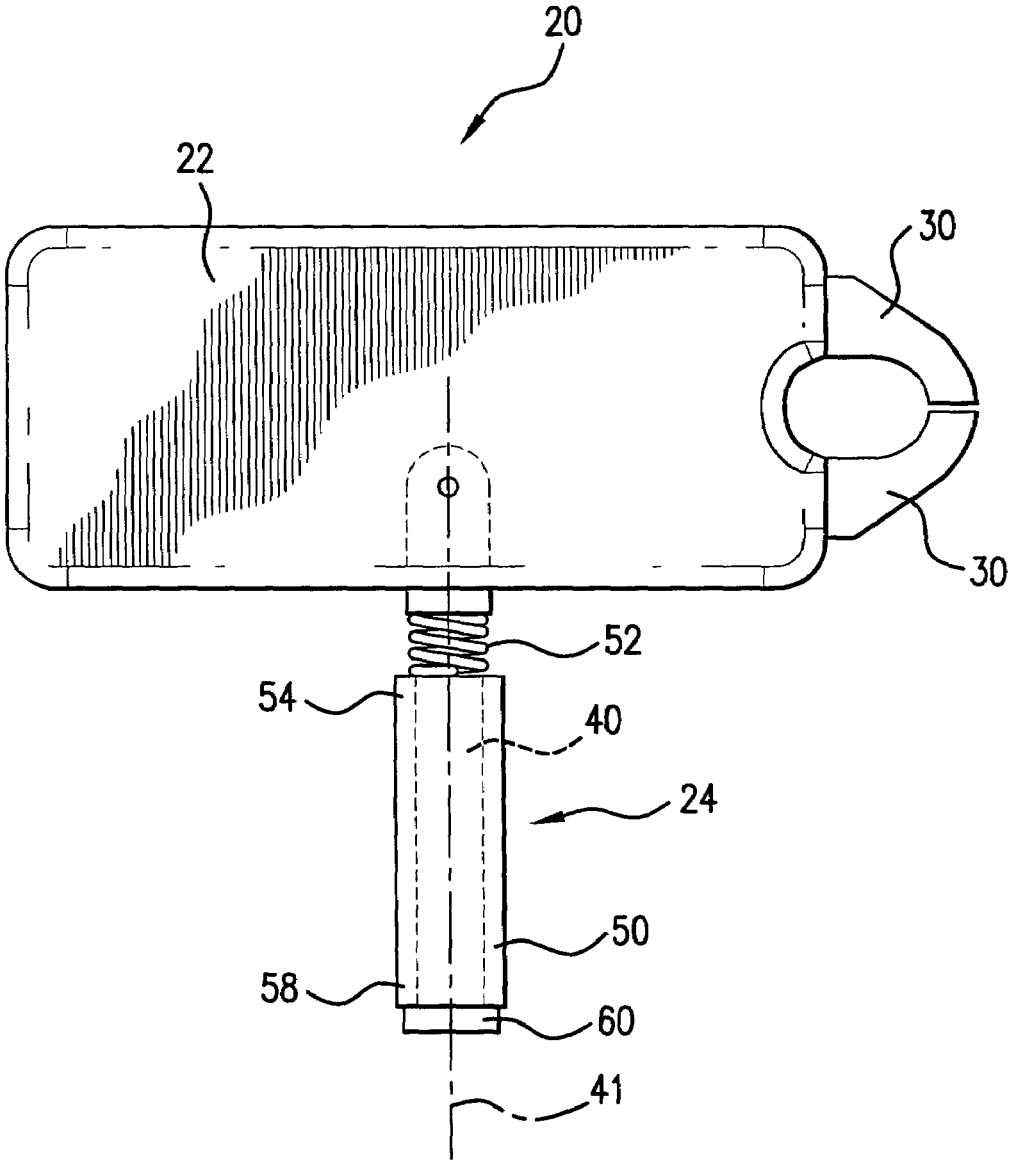

In one preferred embodiment of this invention as shown for example in FIG. 4, a stop element, such as a spring 52, is mounted to or positioned about shaft 40 at a first or inner end portion 54 of sleeve 50 to limit axial movement of sleeve 50 along shaft 40 in a first direction with respect to axis 41. Additionally, it may be desirable for the stop element to urge or bias sleeve 50 in a second direction, generally opposite the first direction. For example, as shown in FIG. 4, spring 52 biases or urges sleeve 50 towards a second or outer end portion 58 of sleeve 50. An end cap 60 is positioned or connected to trigger 24 at outer end portion 58 to maintain sleeve 50 positioned about shaft 40 and limit movement of sleeve 50 along shaft 40 with respect to axis 41 in one direction. As shown in FIG. 5, a second stop element, for example a spring 56, is mounted to or positioned about shaft 40 at outer end portion 58 to limit axial movement of sleeve 50 along shaft 40 in the second direction with respect to axis 41, generally opposite the first direction. The spring force applied by spring 52 and/or spring 56 against sleeve 50 can be tailored or adjusted to specific applications, to maintain a minimum required spring force for proper functioning. Excessive spring force may result in an undesirable torque applied to the trigger.

The term axial movement as used throughout this specification refers to a movement or translation of sleeve 50 along a length of shaft 40, with respect to axis 41. The term rotational movement as used throughout this specification refers to a rotation of sleeve 50 about shaft 40, with respect to axis 41. In certain embodiments of this invention, sleeve 50 may exhibit axial movement along a length of shaft 40 and/or rotational movement about shaft 40.

As shown in FIG. 9, in one preferred embodiment of this invention, spring 52 and spring 56 are positioned about shaft 40 at or adjacent inner end portion 54 and outer end portion 58, respectively, of sleeve 50. Preferably, but not necessarily, at least a portion of spring 52 and/or at least a portion of spring 56 is positioned within a bore formed by sleeve 50. Any other suitable mechanical or electromechanical element may be used that limits, prevents, assists or allows movement of sleeve 50 along at least a portion of the shaft length, such as a resilient washer.

Figure 11:
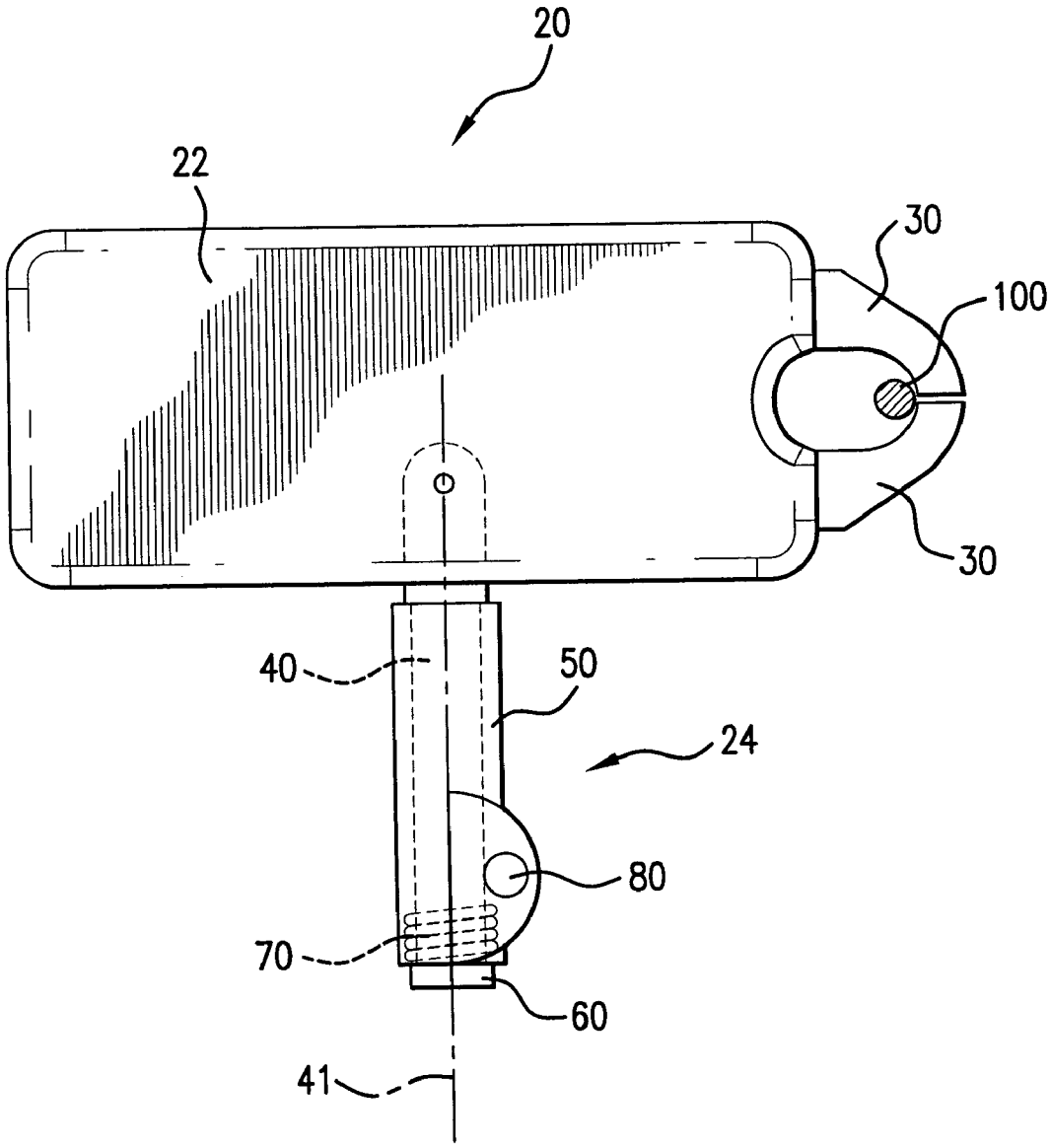
FIG. 11 shows a schematic side view of a mechanical release or trigger device having a safety mechanism operatively connected to a trigger having an asymmetric sleeve, according to one embodiment of this invention.

In one preferred embodiment of this invention, mechanical release or trigger device 20 comprises an asymmetric sleeve 50, such as shown in FIG. 11, to limit rotation or create a neutral rotational position when activating another mechanism, such as a safety or firing system. A bias element, for example a bias spring 70, is operatively connected between shaft 40 and sleeve 50 to limit rotational movement of sleeve 50 about shaft 40. Preferably, bias spring 70 is connected between shaft 40 and sleeve 50 to bias or urge sleeve 50 towards the neutral or starting rotational position. As a user applies a force to trigger 24 to pivot trigger 24 in the pivot direction from the first position to the second position, sleeve 50 rotates about shaft 40 with respect to axis 41 to prevent or limit undesirable lateral movement of mechanical release or trigger device 20 with respect to bowstring 100 positioned within calipers 30. Sleeve 50 can also move along shaft 40 with respect to axis 41 to prevent or limit undesirable vertical movement of mechanical release or trigger device 20 with respect to bowstring 100. During or upon release of trigger 24, sleeve 50 returns to the neutral, idle or starting rotational position as a result of the biasing force that bias spring 70 exerts on sleeve 50.

Alternatively, or in addition to bias spring 70, a stop pin can be connected with respect to trigger 24 to limit the rotation of the asymmetric sleeve 50 about shaft 40 with respect to axis 41. For example, the stop pin may be connected to or formed in an outer surface of shaft 40 to interfere with a portion of sleeve 50 as sleeve 50 rotates about shaft 40, to prevent further rotation of sleeve 50 about shaft 40 beyond a determined rotational limit. Alternatively, the stop pin may be formed in or connected to sleeve 50 to interfere with a portion of shaft 40 as sleeve 50 rotates about shaft 40, to limit rotation of sleeve 50 about shaft 40.

In one preferred embodiment of this invention as shown in FIG. 10, sleeve 50 is segmented and comprises a plurality of sleeve pieces 62 positioned with respect to trigger 24. Sleeve pieces 62 preferably are positioned about shaft 40 along at least a portion of axis 41. Each sleeve piece 62 is rotatable about shaft 40 and is preferably but not necessarily movable along shaft 40. Sleeve pieces 62 are particularly suitable for use with a shaft 40 having a curved or arcuate shape, such as shown in FIG. 10, but sleeve pieces 62 may be used with a cylindrical or straight shaft 40. Sleeve pieces 62 can have any suitable shape and/or size that allows each sleeve piece 62 to rotate freely about and move along shaft 40 while comfortably accommodating or accepting a user's finger.

As shown in FIG. 11, in one preferred embodiment of this invention, at least a portion of sleeve 50 has an asymmetric shape. The asymmetric shape may provide for a mechanism or element, for example a safety lock or device 80 operatively connected to trigger 24 that prevents undesired activation of trigger 24. For example, safety device 80 may prevent a user from pivoting trigger 24 from the first position to the second position, wherein calipers 30 move from the closed position to the open position to release bowstring 100 from within calipers 30.

Figure 12:
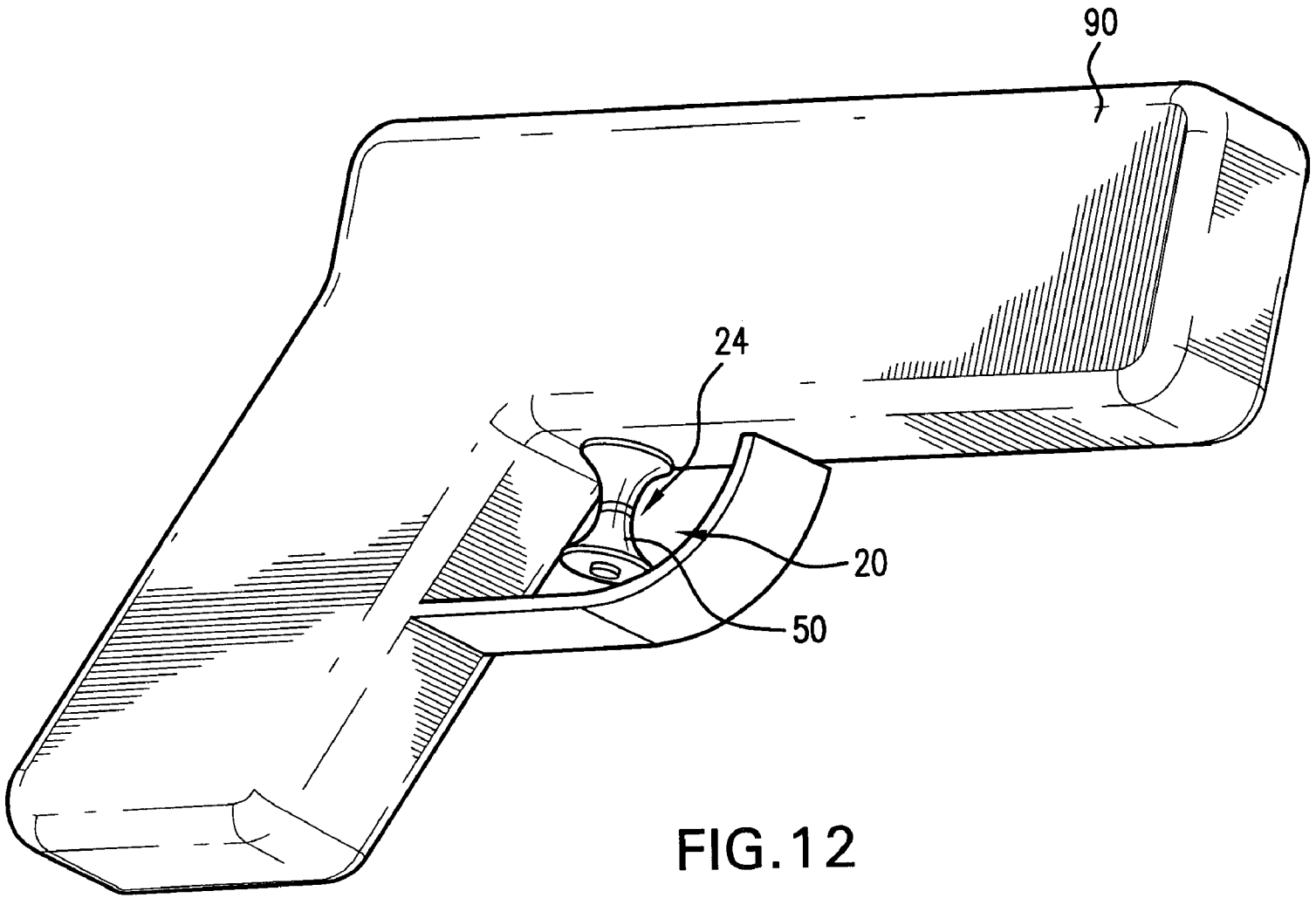
FIG. 12 shows a schematic perspective side view of a mechanical release or trigger device in combination with a firearm, according to one embodiment of this invention.
Figure 13:
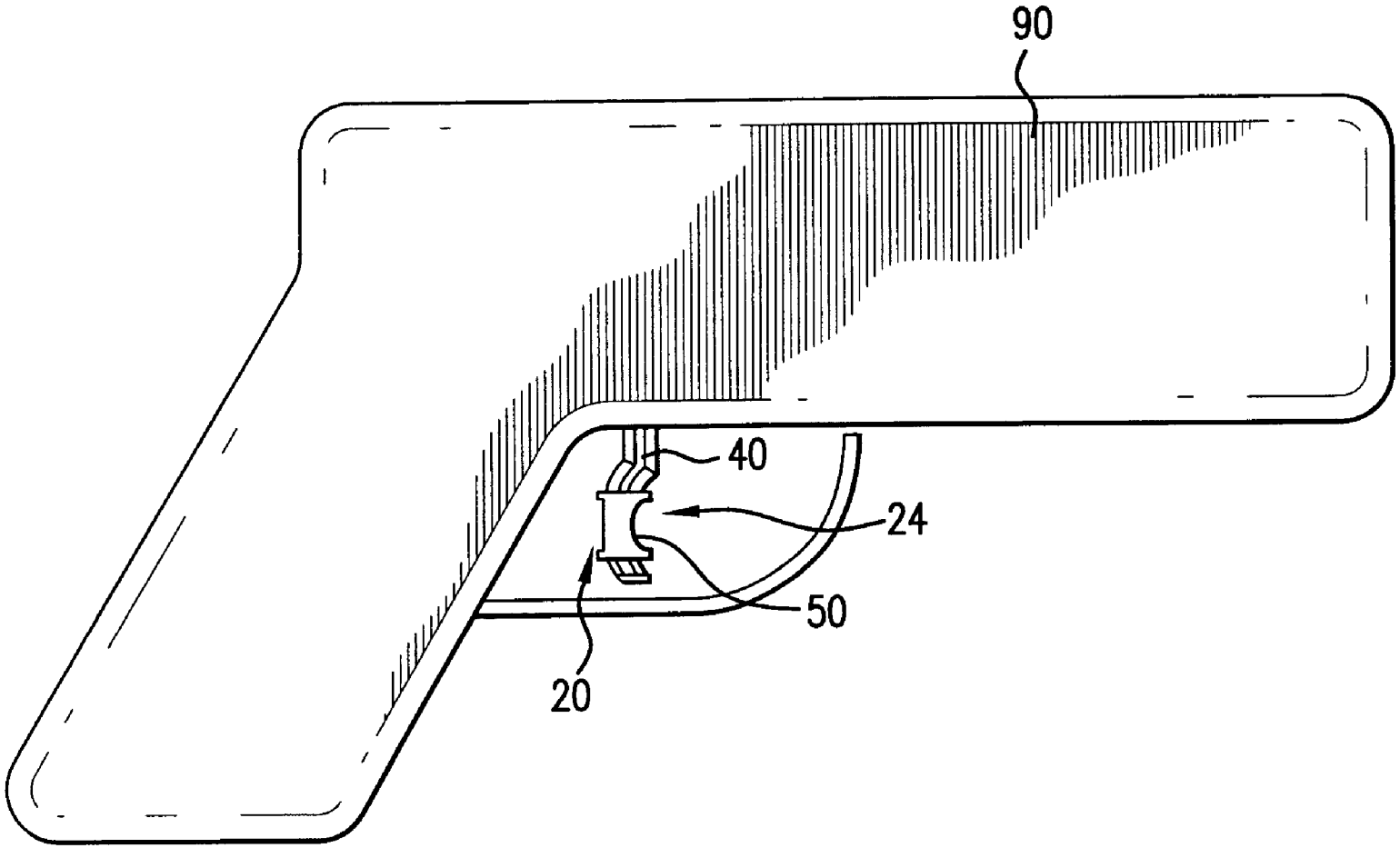
FIG. 13 shows a schematic side view of a mechanical release or trigger device in combination with a firearm, according to one embodiment of this invention.

Mechanical release or trigger device 20 according to this invention can be used with an archery bow or can also be used with a firearm, such as a gun or any other device that requires a pulling action or squeezing action of a trigger, to activate movement of another mechanical element. In one preferred embodiment of this invention, mechanical release or trigger device 20 can be combined with a firearm, for example a gun 90 as shown in FIGS. 12 and 13. Mechanical release or trigger device 20 may comprise a cylindrical trigger 24, such as shown in FIG. 12, or a curved or arcuate shaped trigger 24, such as shown in FIG. 13, movably or pivotally mounted with respect to the gun body and movable or pivotable between a first position and a second position. Further, sleeve 50 may have any suitable size and/or shape.

Similar to the embodiment discussed above wherein mechanical release or trigger device 20 is used in combination with an archery bow to release a bowstring to launch an arrow, mechanical release or trigger device 20 can be used in combination with a gun, or other suitable firearm, to accurately shoot a bullet for example. As a user's finger applies a force to trigger 24 to move or pivot trigger 24 from the first position to the second position, sleeve 50 positioned about trigger 24 rotates about shaft 40 to prevent undesirable lateral movement of gun 90 with respect to a target. Further, sleeve 50 may also move along shaft 40 to prevent undesirable vertical movement of gun 90 with respect to the target.

Conventional trigger mechanisms do not track mechanically in the same path as the human finger. In one preferred embodiment of this invention, mechanical release or trigger device 20 comprises a component or mechanism for tracking mechanically in the same path as the human finger.

The elements of this invention may comprise any suitable material including, but not limited to, metals, alloys, plastics, graphite materials and different metal and/or non-metal composite materials.

While in the foregoing specification this invention has been described in relation to certain preferred embodiments, and many details are set forth for purpose of illustration, it will be apparent to those skilled in the art that this invention is susceptible to additional embodiments and that certain of the details described in this specification and in the claims can be varied considerably without departing from the basic principles of this invention.

What is claimed is:

1. A mechanical release device comprising:

a body;

a trigger movably mounted to the body; and a sleeve connected to the trigger, wherein the sleeve is asymmetric and is rotatable with respect to the trigger.

2. The mechanical release device of claim 1 wherein the trigger is pivotally mounted to the body.

3. The mechanical release device of claim 1 wherein the trigger comprises a shaft, and the sleeve is rotatable about an axis of the shaft.

4. The mechanical release device of claim 1 wherein the trigger comprises a shaft, and the sleeve is movable along a length of the shaft in at least one direction.

5. The mechanical release device of claim 1 further comprising a bias element operatively connected between the shaft and the sleeve limiting a rotational movement of the sleeve about the axis.

6. The mechanical release device of claim 1 further comprising a stop element positioned at a first end portion of the sleeve and limiting axial movement of the sleeve in a first direction.

7. The mechanical release device of claim 6 wherein the stop element comprises a spring operatively connected to the sleeve.

8. The mechanical release device of claim 6 further comprising a second stop element positioned at a second end portion of the sleeve limiting axial movement of the sleeve in a second direction.

9. The mechanical release device of claim 1 further comprising an end cap connected to the trigger.

10. The mechanical release device of claim 1 further comprising at least one caliper operatively connected to the trigger, the at least one caliper movable between a closed position and an open position in response to a movement of the trigger.

11. A combination comprising a firearm and a mechanical release device of claim 1.

12. A combination comprising an archery bow and a mechanical release device of claim 1.

13. A mechanical release device comprising:

a body;

a trigger forming a shaft and pivotally mounted with respect to the body;

at least one caliper mounted with respect to the body and operatively connected to the trigger, the at least one caliper movable between an open position and a closed position in response to a pivotal movement of the trigger; and a sleeve rotatably mounted about the shaft.

14. The mechanical release device of claim 13 further comprising an end cap positioned at a first end portion of the shaft.

15. The mechanical release device of claim 13 further comprising a spring biasing the shaft at a first end portion of the sleeve.

16. The mechanical release device of claim 15 further comprising a second spring biasing the shaft at a second end portion of the sleeve.

17. The mechanical release device of claim 13 wherein the sleeve is asymmetric.

18. The mechanical release device of claim 17 further comprising a bias element operatively connected to the sleeve and biasing the sleeve towards a first position.

19. The mechanical release device of claim 13 wherein the sleeve has a plurality of segments.

20. The mechanical release device of claim 13 wherein the sleeve comprises a cylindrical outer surface.

21. The mechanical release device of claim 13 wherein the sleeve comprises an arcuate outer surface.

22. The mechanical release device of claim 13 wherein at least a portion of an outer surface of the sleeve comprises a resilient material.

23. The mechanical release device of claim 13 wherein the sleeve is rotatable about an axis of the shaft.

24. The mechanical release device of claim 13 wherein the sleeve is movable along an axis of the shaft.

25. A mechanical release device comprising:

a body;

a trigger forming a shaft and movably mounted with respect to the body;

at least one caliper mounted with respect to the body and operatively connected to the trigger, the at least one caliper movable between an open position and a closed position in response to a movement of the trigger;

a sleeve rotatably mounted with respect to the trigger and movable along an axis of the shaft; and at least one stop element mounted with respect to the shaft at one of a first end portion of the sleeve and a second end portion of the sleeve.

26. The mechanical release device of claim 25 wherein the trigger is pivotally mounted with respect to the body, and the at least one caliper is movable between the open position and the closed position in response to a pivotal movement of the trigger.

27. The mechanical release device of claim 25 further comprising a bias element operatively connected to the sleeve and biasing the sleeve towards a first position, wherein the sleeve is asymmetric.

28. A mechanical release device comprising:

a body;

a trigger movably mounted to the body;

a sleeve connected to the trigger, and the sleeve rotatable with respect to the trigger; and a stop element positioned at a first end portion of the sleeve and limiting axial movement of the sleeve in a first direction.

29. The mechanical release device of claim 28 wherein the sleeve is asymmetric.

30. A mechanical release device comprising:

a body;

a trigger movably mounted to the body;

a sleeve connected to the trigger, and the sleeve rotatable with respect to the trigger; and an end cap connected to the trigger.

* * * * *